US007768397B1

(12) United States Patent
Kelsch et al.

(10) Patent No.: US 7,768,397 B1
(45) Date of Patent: Aug. 3, 2010

(54) CABLE ASSEMBLY FOR SECURING HINGED PRODUCTS

(75) Inventors: Christopher A. Kelsch, Tarpon Springs, FL (US); John N. Figh, Jr., Valrico, FL (US); Thomas J. Beach, Seminole, FL (US); Lucas P. Swartwood, Tampa, FL (US)

(73) Assignee: Vanguard Products Group, Inc., Oldsmar, FL (US)

( * ) Notice: Subject to any disclaimer, the term of this patent is extended or adjusted under 35 U.S.C. 154(b) by 249 days.

(21) Appl. No.: 11/686,412

(22) Filed: Mar. 15, 2007

Related U.S. Application Data

(60) Provisional application No. 60/824,301, filed on Sep. 1, 2006.

(51) Int. Cl.
*G08B 13/08* (2006.01)

(52) U.S. Cl. ..... 340/545.6; 340/686.1

(58) Field of Classification Search ..... 340/545.6, 340/568.1, 568.2, 686.1; 70/58
See application file for complete search history.

(56) References Cited

U.S. PATENT DOCUMENTS 5,055,827 A 10/1991 Philipp
5,787,738 A * 8/1998 Brandt et al. ..... 70/58
5,836,183 A 11/1998 Derman
5,933,322 A 8/1999 Ruch et al.
6,150,940 A 11/2000 Chapman et al.
6,216,499 B1 4/2001 Ronberg et al.
6,227,017 B1 5/2001 Igelmund
6,294,995 B1 * 9/2001 Patterson ..... 340/568.1
6,297,963 B1 10/2001 Fogle
6,308,928 B1 10/2001 Galant
6,337,633 B1 1/2002 Foseide
6,386,906 B1 5/2002 Burke
6,477,871 B1 11/2002 Shaw et al.
6,601,416 B1 8/2003 Sanders
6,624,753 B2 * 9/2003 Elston ..... 340/568.1
6,761,579 B2 7/2004 Fort et al.

(Continued)

OTHER PUBLICATIONS

Computer Security Products, Inc. CSP-4040/CSP-4041, Laptop tie-down bracket, www.computersecurity.com/computer_cage/csp-4040.htm, 2 pages , Nov. 15, 2005.

(Continued)

*Primary Examiner*—John A Tweel, Jr.
(74) *Attorney, Agent, or Firm*—Patzik, Frank & Samotny Ltd.

(57) ABSTRACT

A security device for preventing theft of a hinged electronic product comprising a band that is inserted through the open area about the hinge of the product and a pair of anchor assemblies that are attached to the ends of the band. Alternatively, the security device may include a cable that extends about the hinge and is secured in an anchor assembly. A tether or cable attaches the security devices to an object to permit the hinged product to be moved over a limited distance. The security device also is connected to an alarm system so that removal or tampering with the band or cable activates the alarm. Filaments and contacts may also be used to detect the presence of the band within the second anchor assembly. An indicator may also provide notice when the security device is armed and/or tampered with.

30 Claims, 14 Drawing Sheets

U.S. PATENT DOCUMENTS

| | | | | |
|---|---|---|---|---|
| 6,799,994 | B2 | 10/2004 | Burke | |
| 6,896,543 | B2 | 5/2005 | Fort et al. | |
| 6,918,272 | B1 | 7/2005 | Sanders | |
| 6,972,677 | B2 | 12/2005 | Coulthard | |
| 6,977,576 | B2 | 12/2005 | Denison et al. | |
| 7,021,091 | B2 | 4/2006 | Leyden et al. | |
| 7,212,115 | B1 * | 5/2007 | Fawcett | 340/545.6 |
| 7,256,692 | B2 * | 8/2007 | Vatsaas et al. | 340/550 |
| 7,315,253 | B1 * | 1/2008 | Pijanowski et al. | 340/686.1 |
| 2001/0049222 | A1 | 12/2001 | Fort et al. | |
| 2004/0035157 | A1 | 2/2004 | Petrick et al. | |
| 2004/0150523 | A1 * | 8/2004 | Kelsch et al. | 340/568.1 |
| 2005/0012591 | A1 | 1/2005 | Tomljenovic et al. | |
| 2005/0024221 | A1 * | 2/2005 | Jamison-Lenz et al. | 340/568.1 |
| 2005/0157460 | A1 | 7/2005 | Bhogal et al. | |
| 2008/0045069 | A1 * | 2/2008 | Haren | 340/568.2 |
| 2008/0129503 | A1 * | 6/2008 | Bonato | 340/568.2 |

OTHER PUBLICATIONS

Computer Security Products, Inc., Laptop Cable Kits, Universal Laptop twist lock, www.computersecurity.com/laptop/cables.htm, 3 pages , Nov. 11, 2005.

Computer Security Products, Inc., Laptop Cables & Locks, QuickLock-CL, Snap-It, etc. www.secure-it.com/products/notebook.htm, 2 pages , Nov. 16, 2005.

Co-pending U.S. Appl. No. 11/745,733, filed May 8, 2007, Entitled Security Device for Hinged Products assigned and having a common inventor and assignee with the present application.

* cited by examiner

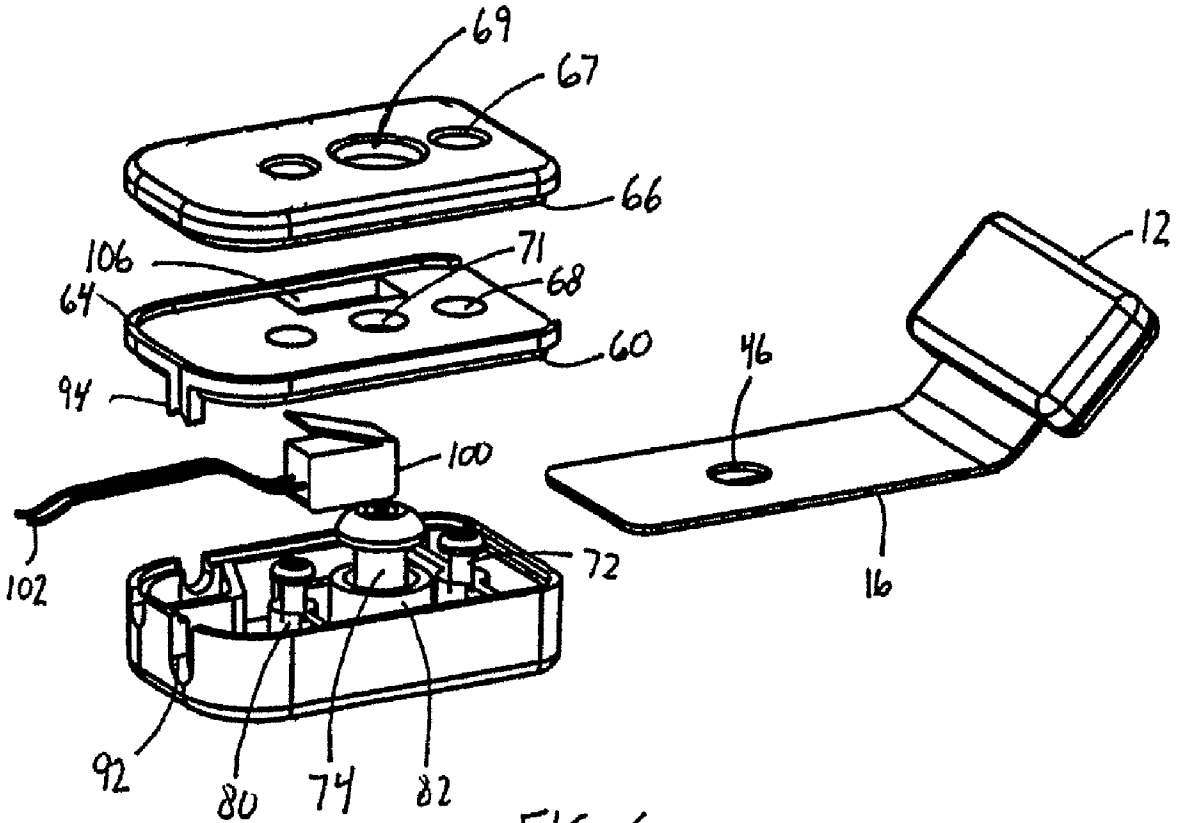
FIG. 6
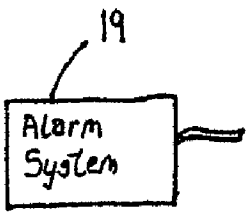

CABLE ASSEMBLY FOR SECURING HINGED PRODUCTS

This application claims priority to U.S. Provisional Patent Application Ser. No. 60/824,301, filed Sep. 1, 2006.

FIELD OF THE INVENTION

This invention relates in general to security and anti-theft devices, and more particularly, to a security device for a hinged electronic product or device to prevent theft of such item.

BACKGROUND OF THE INVENTION

In order to deter and prevent the theft of various hinged electronic items such as laptop computers and portable DVD players and the like from offices, houses and other establishments, various security devices and systems have been developed. One known security device comprises a bracket assembly that captures the laptop about its hinge and is fixedly attached to a table or other object to prevent movement of the hinged device. It is also known to use a cable that encircles the hinge in place of the brackets. While such devices may work, the brackets and cable are often cumbersome and are not aesthetically pleasing (e.g., for use in store displays). Furthermore, use of the bracket assemblies or known cables substantially prevents movement of the laptop. Accordingly, such devices are not favored by retailers and other business establishments who desire the product to be picked up and examined by potential purchasers, in as close to actual use conditions as possible.

It is also known to use a detector that is screwed into the video port, wherein an alarm goes off if anyone tries to unscrew the detector. However, it is desired to eliminate the need for having to screw a detector into the video port. Yet another known device utilized an electronic sensor that would go off if one tried to remove the cable from the hinged device. While these systems may work, they were not well received by the business community because they lacked a mechanical tether.

Additionally, it has been known to use a KENSINGTON® port that utilizes a security cable having a loop at one end such that, after the cable is wrapped about an object, the other end of the cable may pass through the loop and be attached to the KENSINGTON port on the computer. However, such systems permit the computers to be stolen by breaking off part of the computer about the KENSINGTON port, thereby leaving the laptop housing damaged, but not affecting the operability of the computer.

Therefore, there is a need to produce a security device capable of protecting against theft of a hinged electronic device, while permitting movement and use of the electronic device, and which addresses the problems with the prior systems and devices, without damaging the hinged device.

SUMMARY OF THE INVENTION

The present invention is an improvement over the prior security systems in the way that the security device protects a hinged product such as a laptop or portable DVD player. In one embodiment, the security device of the present invention comprises a band or plate having a height that permits it to extend through the open area about the hinge of a hinged electronic product (i.e., the area between the screen and the body). Anchor assemblies fixed or attached to both ends of the plate are sized so that they (and thus the plate) may not be pulled through the hinge. In particular, a first anchor assembly may include a bottom and top half that collectively include a male member and a corresponding female member that can extend through a slot on the end of the plate. Once the halves of the first anchor assembly are attached together (e.g., by ultrasonic welding), the first anchor assembly is thus fixed in place relative to the plate.

A hole extending through the plate is sized to receive the elongated body of a fastener for connecting the plate to the second anchor assembly. The second anchor assembly may include a base and a lid assembly that may be attached together by a pair of fasteners and that include a slot for receiving the plate. In one embodiment, the lid assembly includes a pair of holes that have an upper portion sized to permit the head of the fastener to be recessed within the bottom of the lid assembly. The lower portion is sized so that the fastener head may not pass therethrough. Accordingly, once the plate is inserted into the corresponding slot of the second anchor assembly, the plate will cover and prevent access to the fastener heads.

A tether extends from the second anchor assembly to securely attach the security device and hinged electronic product to an object, thereby allowing the hinged electronic product to be securely moved a limited distance. The tether may comprise one or more wires for electronically attaching the security device to an alarm system to, among other things, set off an alarm when the tether is cut.

In order to detect the presence of the plate, the second anchor assembly may include a lever switch so that insertion of the plate into the slot of the second anchor assembly depresses the lever to complete an electrical circuit and arm the device. Subsequent attempted removal of the plate acts to open the circuit and activate the alarm.

The security device may also include a sensor attachable to the hinged electronic product to detect attempted removal of the security device from the hinged product. In one embodiment, the sensor comprises a sensor housing having a button extending outwardly from its bottom and that is depressed when attached to the surface of the hinged product to complete an electrical circuit. The bottom of the sensor includes an adhesive sheet to adhere to the surface of the hinged product. A release liner may be placed over the adhesive sheet when not in use to protect the adhesive sheet. In operation, depression of the button when the sensor is placed onto the surface of the hinged electronic product acts to close the electrical circuit. An indicator (e.g., an LED) associated with the sensor may then indicate that the sensor is armed. Attempted removal of the security device and/or the sensor that causes the sensor to be removed from the surface of the hinged product will open the circuit and activate an alarm in the form of a visual (e.g., an LED) and/or audio response.

A circuit board may be located inside the anchor assembly to assist in monitoring the status of the security device. In one embodiment, the circuit board is an intelligent device that may be connected to and monitor resistance of the lasso assembly or cable to determine when it is tampered with or cut. A LED on or associated with the lasso may be operatively connected to the circuit board to flicker, blink, indicate or otherwise indicate tampering with the lasso assembly.

The second anchor assembly may also include at least one electrical circuit for detecting the attempted removal or tampering with the security device. In one embodiment, the plate may include a pair of electrical contacts that are connected to an alarm system through filaments and corresponding contacts. When the fastener is inserted through the hole in the plate to attach the plate to the second anchor assembly, the head of the fastener or a washer engages the pair of electrical contacts to form an electrical circuit. Removal or attempted removal of the fastener re-opens or breaks the electrical path between the pair of contacts, which can be detected by a security or alarm system. The aforementioned electrical circuit or another electrical circuit may also be operatively attached to an indicator such as a light emissive device (e.g., an LED) to indicate when the security device is armed. The plate may also include filaments that detect when an attempt is made to cut the plate and trigger a visible and/or audible alarm.

In an alternate embodiment, the plate may include raised portions that engage brush-type contacts located in the second anchor assembly when the plate is inserted into the second anchor assembly to complete an electrical circuit for indicating that the system is armed and detecting the removal of the plate from the second anchor assembly.

Alternatively, the security device may utilize a cable that may extend about the hinge and be secured to an anchor assembly through a plurality of slots. In one embodiment, the cable comprises a singular cable that includes a pair of straight sections that are spaced apart a distance to align with corresponding slots on the anchor assembly. The straight sections are joined together at one end by a curved member so that when the cable is secured by a screw or other fastener in the anchor assembly and the curved member prevents the cable from being withdrawn without removing the fastener. At the other end of the straight sections are curved portions that permit the ends of the cables to extend substantially parallel to the straight sections so that they also may be placed within the respective slots on the front side of the anchor assembly. End members having a diameter or width that is greater than the width of the respective slot are preferably attached to the ends of the cables to prevent the ends from being withdrawn once operatively connected to the anchor assembly. The curved portions of the cable are sized and shaped so that the hinge member of the computer or other device fits therwithin.

It is therefore an object of the present invention to provide a new and improved security device for use in the prevention of theft.

Another object of the present invention is to provide a new and improved security device that permits movement of a hinged product.

It is yet another object of the present invention to produce a security device that is economical and easy to manufacture and use.

Other objects, features and advantages of the invention will be apparent from the following detailed disclosure, taken in conjunction with the accompanying sheets of drawings, wherein like reference numerals refer to like parts.

BRIEF DESCRIPTION OF THE DRAWINGS

FIG. 6 is an exploded perspective view of another embodiment of the security device of the present invention illustrating a switch for detecting the presence of the plate.

DETAILED DESCRIPTION OF THE INVENTION

Figure 1:
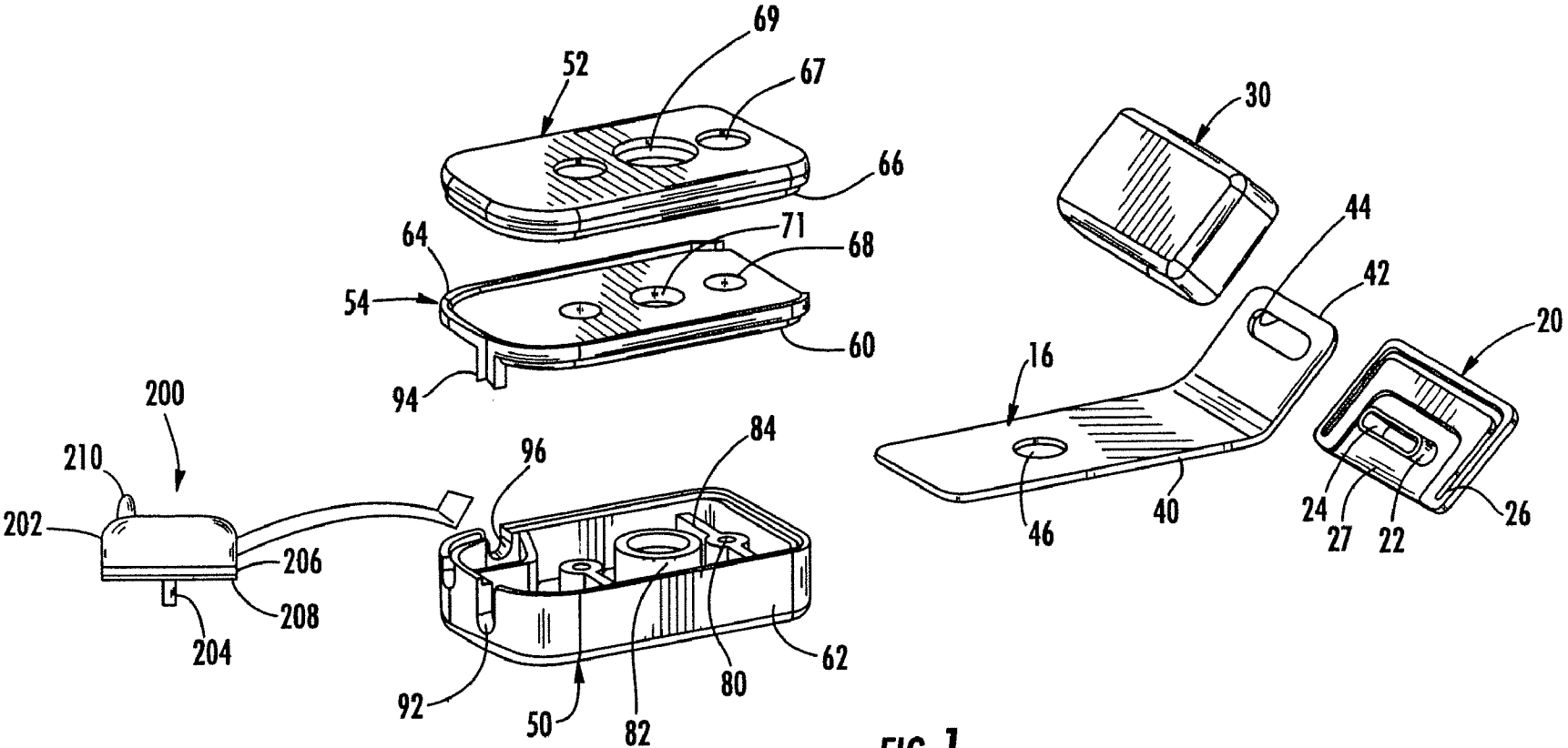
FIG. 1 is an exploded perspective view of one embodiment of the security device of the present invention

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

Figure 2:
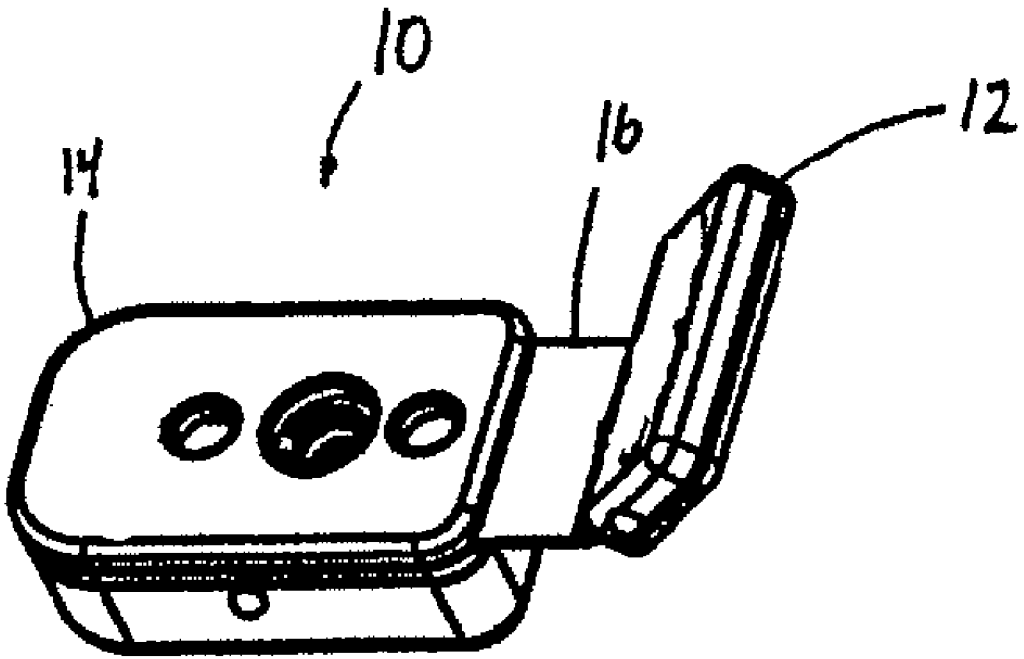
FIG. 2 is a perspective view of the assembled security device of FIG. 1.
Figure 3:
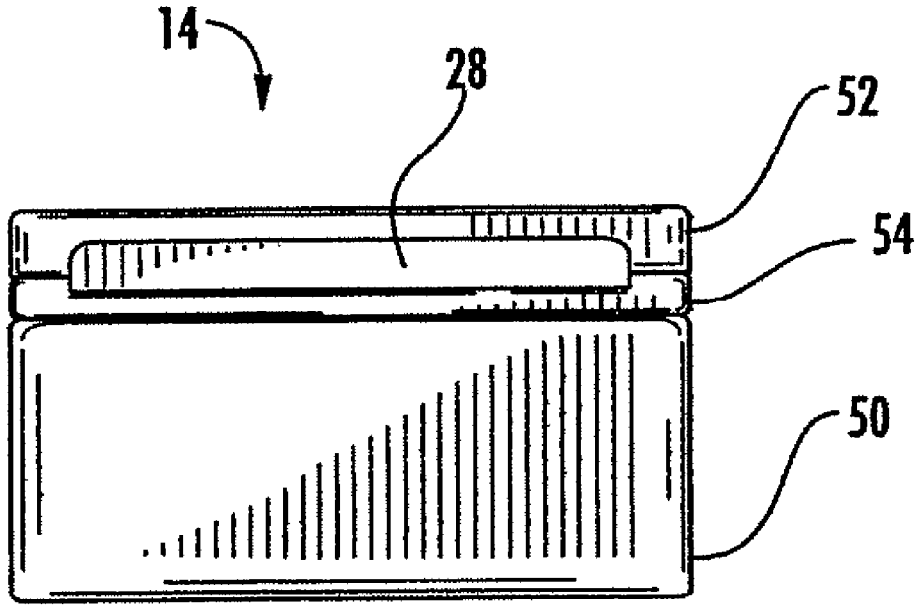
FIG. 3 is side elevation view of an anchor assembly of the security device of FIG. 2 showing a slot for receiving the plate.
Figure 4:
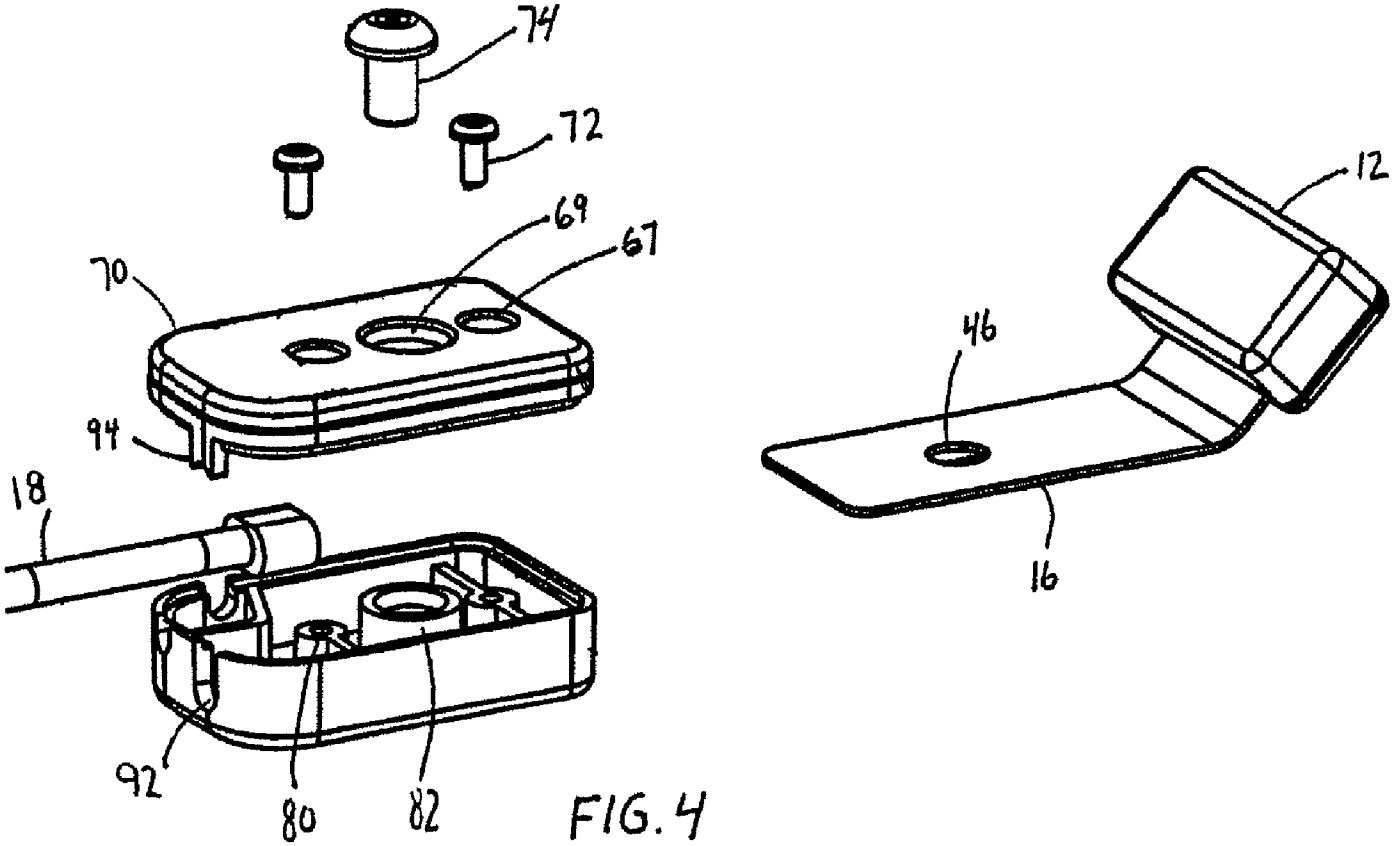
FIG. 4 is a partially exploded perspective view of the security device of FIG. 1 showing a cable and a plurality of screws for attaching the lid to the base of the anchor assembly.

Referring now to the drawings, and particularly to FIGS. 1 through 5, there is shown one embodiment of the present invention. The security device of the present invention, generally designated by the number 10, is shown in FIGS. 2 and 4 as having a first anchor assembly 12, a second anchor assembly 14, a band or plate 16, and a tether or cord 18 for mechanically and/or electronically securing the security device. While the embodiment disclosed herein refers to a laptop computer, it is appreciated that the security device may be used with any type of hinged electronic product including, but not limited to, portable DVD players and video game players, and not depart from the scope of the present invention.

Figure 10:
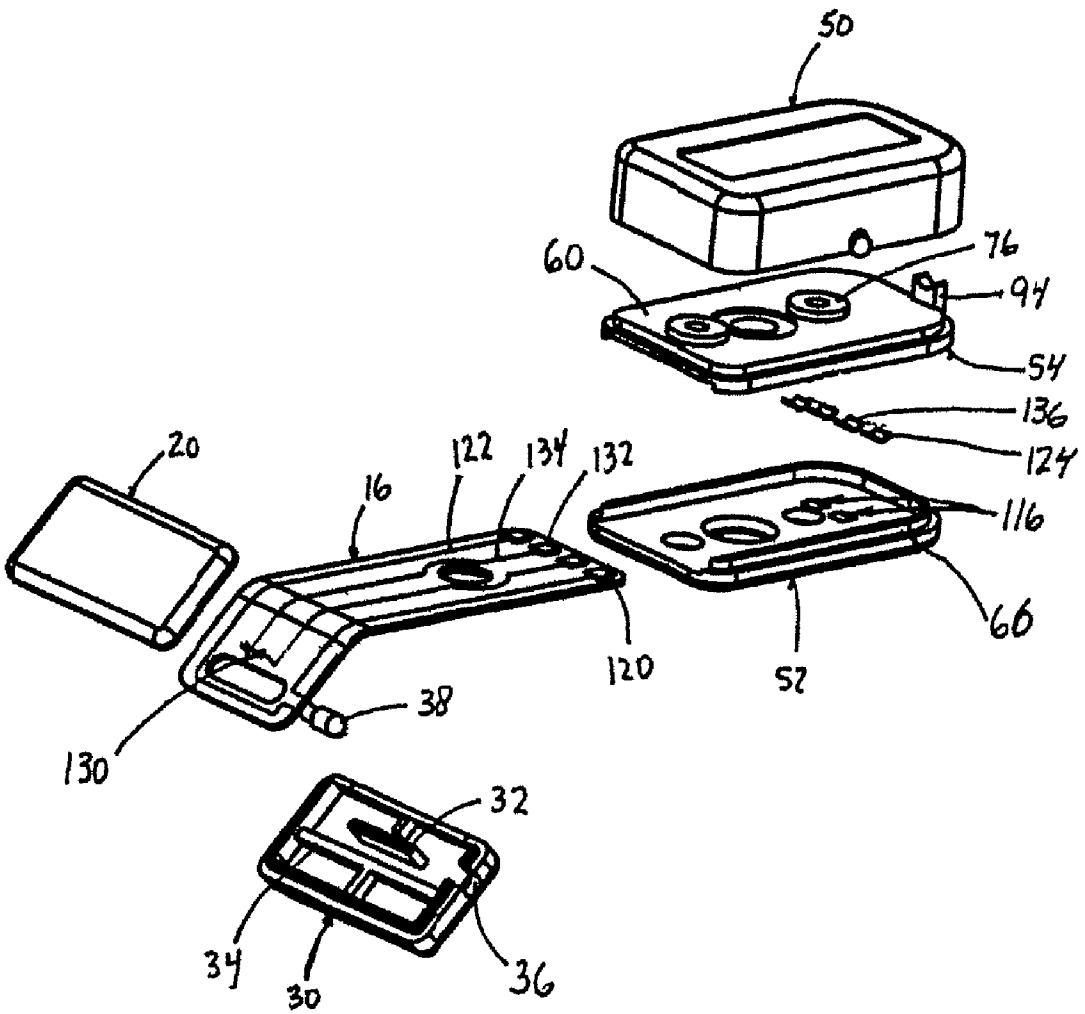
FIG. 10 is an exploded bottom perspective view of the security device of FIG. 9 showing a plurality of contacts and filaments.

The first anchor assembly 12 may be made out of a variety of materials including, but not limited to, plastic. A suitable material is a thermoplastic material such as Acrylonitrile-butadine-styrene (ABS) to provide suitable environmental ruggedness at a relatively low cost. In order to facilitate its manufacturing and assembly, the first anchor assembly 12 may be made of two halves. Referring to FIGS. 1 and 10, the bottom half 20 of the first anchor assembly 12 includes a female member comprising a wall 22 extending upward from the inner portion of the bottom half and that defines a substantially oval cavity 24. A wall or rim 26 also may extend about three sides of the bottom half 20 to create an opening 27 to permit the plate 16 to extend through when the halves 20, 30 are fixed together.

The top half 30 includes a male member or wall 32 extending upward that is sized to fit within the cavity 24 of the first anchor assembly 20 so that the bottom and top halves 20, 30 may integrally form the first anchor assembly 12 and be held in place relative to the plate 16. The halves may also include one or more ribs 34 to enhance the rigidity and strength of the assembly. Referring to FIG. 10, one side of the top half 30 may include an opening 36 to permit an indicator such as a light emissive device 38 (e.g., an LED) to extend therethrough. Once placed together, the top and bottom halves may be fixed together using an ultrasonic weld or other known means.

Figure 5:
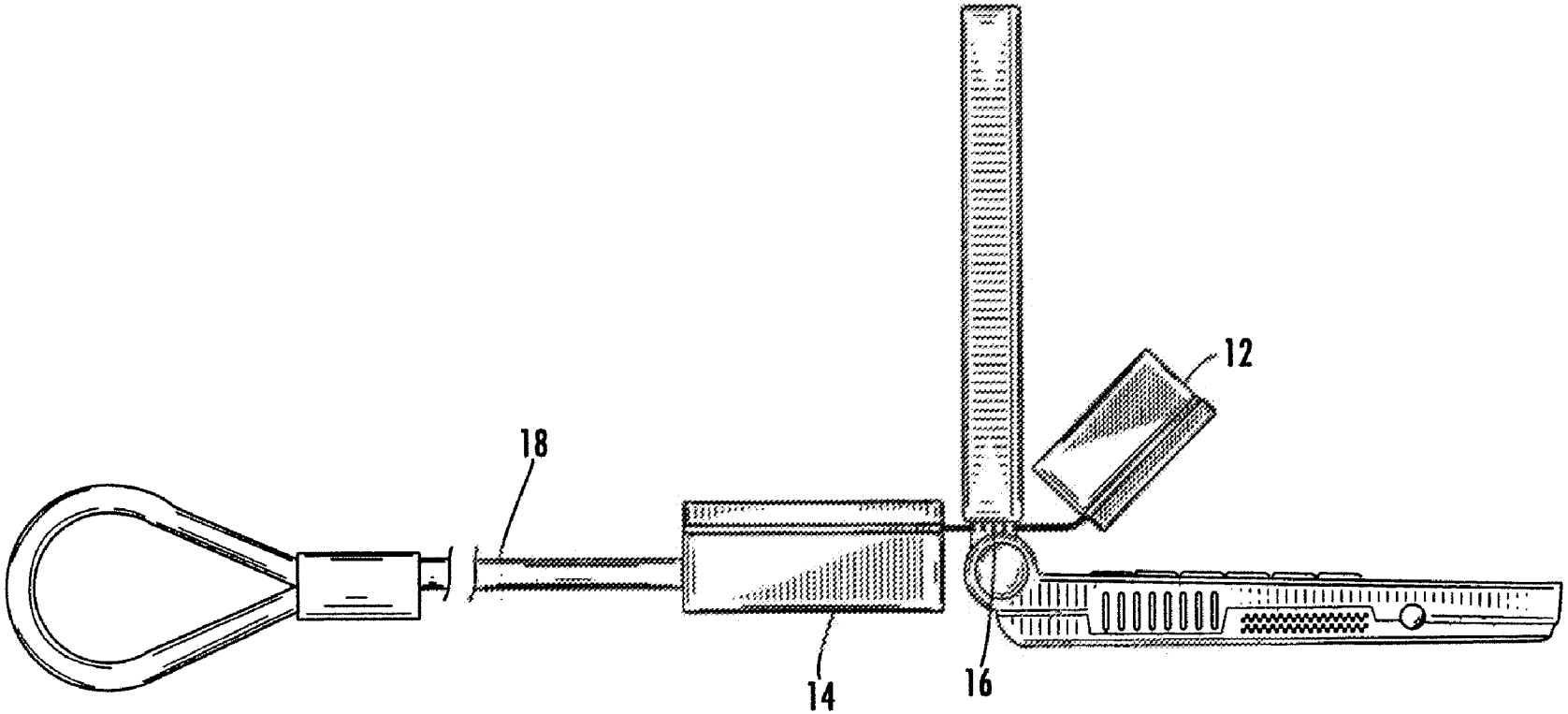
FIG. 5 is a side elevation view of the security device shown in FIG. 4.

The plate or band 16, as shown in FIGS. 1 and 5, may be made from a piece of material having a main body member 40 having a height H that is less than the height of the open area defined by the screen and the body of the computer about the hinge. While the plate may be made from a variety of materials having sufficient strength, one embodiment may comprise a spring metal plate. Furthermore, while a plate or band is shown and disclosed, a cable or other means to extend through the hinge opening and connect the two anchor assemblies may be used and not depart from the scope of the present invention.

Referring again to FIGS. 1 and 5, the end 42 of the plate 16 is preferably angled upwardly so that, when the first anchor assembly 12 is attached thereto, and the security device 10 is operably attached to the laptop, the anchor assembly 12 and plate 16 do not interfere with the ability to use the keypad of the computer or otherwise interfere with the use of the computer or other electronic product. A slot 44 in the end 42 of the plate 16 is sized to accept the male and female members 22, 32 of the bottom and top halves 20, 30 therein so that when the halves 20, 30 are affixed to one another, they are also retained in place relative to the plate 16. It is appreciated that in order to limit movement of the first anchor assembly, the male and female members may be sized to snugly fit within the slot. The plate also includes a hole 46 for receiving a fastener 74 for attaching the plate 16 to the second anchor assembly 14.

As shown in FIG. 1, the second anchor assembly 14 includes a base 50, a lid 52 and an insert 54. The second anchor assembly 14 may be made out of a variety of materials including, but not limited to, plastic. A suitable material is a thermoplastic material such as Acrylonitrile-butadine-styrene (ABS) to provide suitable environmental ruggedness at a relatively low cost. In one embodiment, the base, lid and insert are designed so that they create a substantially flush exterior when attached together. Referring now to FIGS. 1 and 10, the insert 54 may have a lower surface 60 that is sized to fit within the walls 62 of the base 50. In a preferred embodiment, the lower surface is sized to snugly fit within the opening in the base to prevent or limit the amount of movement or play of the insert relative to the base.

Referring again to FIG. 1, the insert includes a wall 64 extending about the rim of the insert except for an open area extending along its front side. Similarly, the lid 52 includes a wall 66 extending a distance offset from its rim substantially equal to the width of the wall 64 to permit the walls 64, 66 to overlap. Together, the walls 64, 66 define the opening 28 for receiving and housing the plate 16.

Once placed together, the insert 54 and lid 52 may be fixed together using an ultrasonic weld or other known means to securely form a lid assembly 70, as shown in FIG. 4. While the device is shown and disclosed as consisting of a separate insert and lid, it is appreciated that the pieces may be integrally formed and not depart from the scope of the invention.

The base 50, lid assembly 70 and plate 16 may be connected together through a plurality of fasteners. One embodiment, as shown in FIG. 4, utilizes a pair of bolts or screws 72 for connecting the base 50 and lid assembly 70, and a bolt or screw 74 for securing the plate 16 to the second anchor assembly 14. In the embodiment shown, the lid 52 and insert 54 each contain a pair of holes 67, 68 for the screws 72 and a central hole 69, 71 for the screw 74, while the base 50 includes corresponding threaded cylinders 80, 82 for receiving the respective screws 72, 74.

Ribs 84, as shown in FIG. 1, may be added to the base to provide rigidity and additional support for the lid assembly 70. The base 50 also includes one or more holes or slots 92, 96 for permitting one or more tethers or cables to extend therethrough to mechanically or electronically attach the security device, as shown in FIGS. 1, 4-6. For example, as shown in FIG. 4, a lasso cable assembly 18 may be inserted through hole 92. The cable assembly may be used to tether the security device to an object (e.g., a table), thereby allowing a portable hinged electronic device to be moved over a limited allowable range, yet still be prevented from being stolen. The cable assembly also may include one or more wires or filaments 102 operatively attached to an alarm system 19, as shown in FIG. 6, to alert the user when the cable assembly is cut or tampered with or to send signals from electrical circuits or sensors as discussed herein. It is appreciated that the security device may include one or more additional cables or wires to connect the electrical circuits and sensors to the alarm system. In order to maintain or secure the cable assembly 18 within the opening 92, the insert may include a post 94 that extends into the opening 92 to straddle or engage the cable assembly 18, as seen in FIG. 4.

Figure 7:
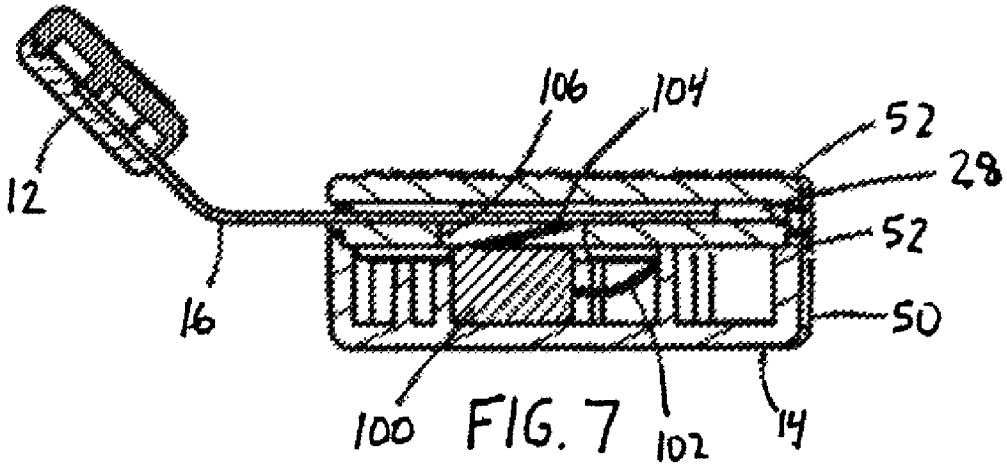
FIG. 7 is a cross-sectional view of the security device shown in FIG. 6 illustrating the plate inserted into the anchor assembly and the switch in a closed position.
Figure 8:
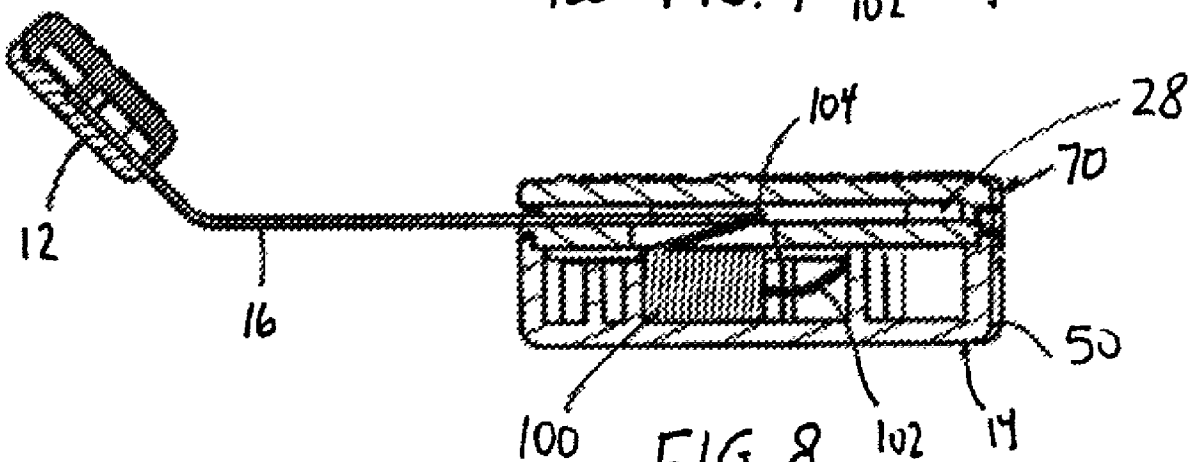
FIG. 8 is a cross-sectional view of the security device shown in FIG. 6 illustrating the plate partially withdrawn from the anchor assembly and the switch in an open position.

In addition or alternatively, the security device may include a lever switch 100 operatively attached to an alarm system 19 through one or more wires 102, as shown in FIG. 6. As shown in FIGS. 7 and 8, the lever switch 100 is placed within the base 50 so that switch or lever arm 104 extends through an opening 106 in the insert 54 and into the opening created by the insert 54 and lid 52. When not in use (i.e., when the plate 16 is not inserted into the opening 28 in the lid assembly 70), the lever switch 104 is in an open position. Insertion of the plate 16 into the opening 28 in the lid assembly 70 pushes down on the lever switch 104 to close the switch, wherein the act of removing the plate 16 from the opening opens the switch 100 and activates the alarm associated with the alarm system 19.

The security device may also include a sensor 200 that may be attached to the hinged electronic product to detect the attempted removal of the security device from the hinged product, as shown in FIG. 1. In one embodiment, the sensor 200 comprises a sensor housing 202 having a spring-loaded button 204 extending outwardly from the bottom of the sensor 200 that is depressed when attached to the surface of the hinged product. The bottom of the sensor 200 includes an adhesive sheet 206 to adhere to the surface of the hinged product. A release liner 208 may be placed over the adhesive sheet 206 when not in use to protect the adhesive sheet 206. In operation, depression of the button 204 engages and pushes a conductor to complete an electrical circuit. An indicator 210 (e.g., an LED) associated with the sensor may then indicate that the sensor is armed. Attempted removal of the security device and/or the sensor will cause the sensor to lose contact with the surface of the hinged product, thereby opening the circuit and activating an alarm. The alarm may be in the form of a visual (e.g., an LED) and/or an audio response.

Figure 17:
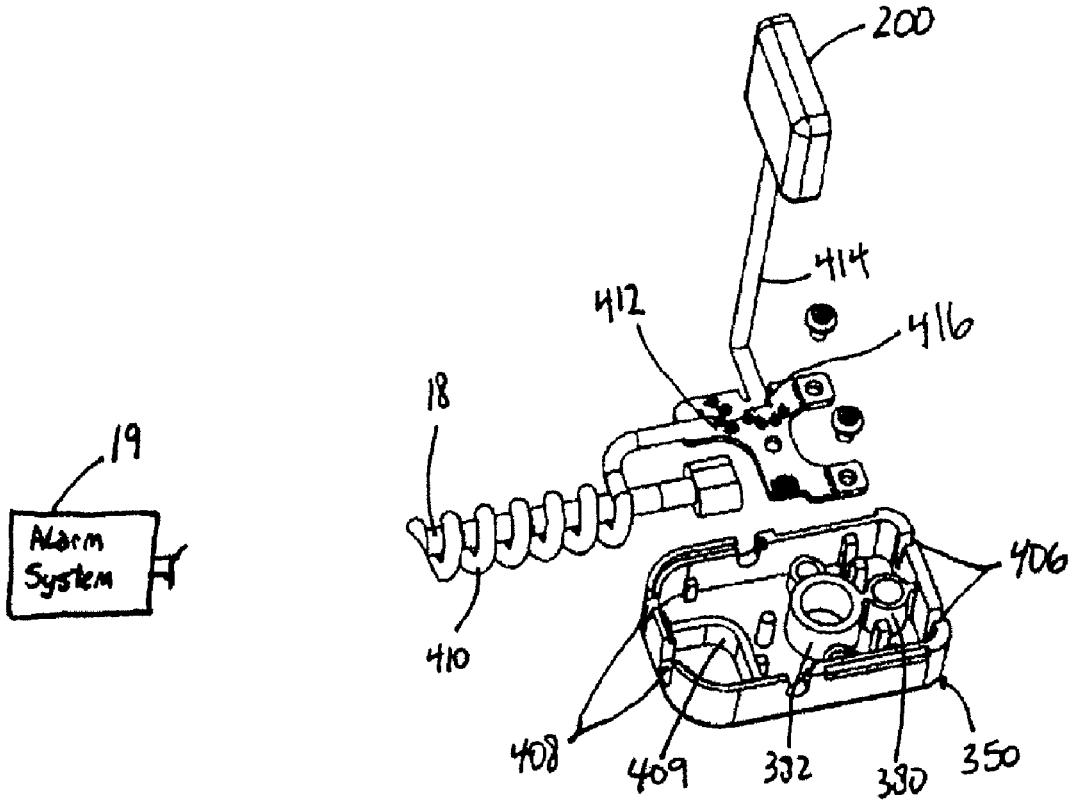
FIG. 17 is a partial exploded view of the security device of FIG. 13 showing the connections to the circuit board.

As shown in FIG. 17, the security device may include a circuit board located within the anchor assembly. In a preferred embodiment, the circuit board is an intelligent device to monitor the status of the security device.

In order to increase the security of the second anchor assembly, the holes 67 in the lid 52 and may be sized so that their diameter is larger than the diameter of the head of the screws 72 to permit the heads of screws 72 to pass therethrough. Referring to the embodiments shown in FIGS. 1-10, the holes 68 of the insert 54 include an upper region having a diameter larger than the diameter of the screw head and a lower region having a diameter smaller than the diameter of the screw head to permit the screws to be recessed yet retained within the insert. Accordingly, when the plate is inserted into and retained within the second anchor assembly, the screws are covered by the plate, thereby preventing the lid assembly from being removed from the base. In order to facilitate manufacturing of the insert, a raised surface or other embossed area 76 may be attached or located about the bottom of the holes to provide a contact surface for the screws to attach the lid assembly to the base. While the screws or fasteners may be made out of a variety of materials or types, in one embodiment, the screws 72 may be types like plastite screws. It is further appreciated that the screw 74 may be a pin-in-hex or other security screw to inhibit its removal.

Figure 9:
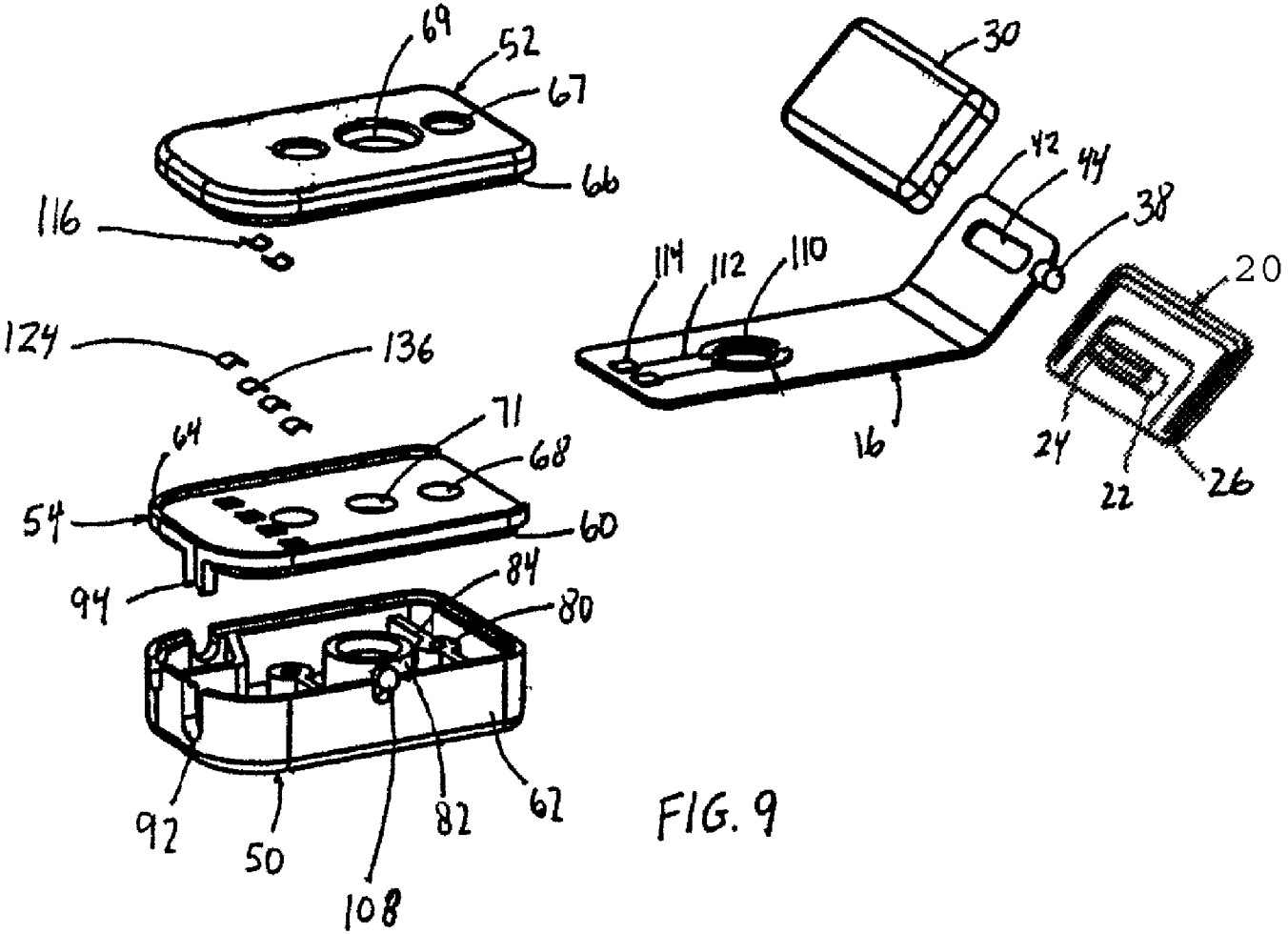
FIG. 9 is an exploded top perspective view of another embodiment of the security device of the present invention showing a plurality of contacts and filaments.

Referring now to FIG. 9, an example embodiment for detecting engagement of the screw 74 with the plate 16 is shown. The plate 16 includes a first and second electrical contact 110. The contacts 110 are connected to an alarm system 19, shown in FIG. 6, through a pair of conductive filaments or wires 112 and corresponding contacts 114, 116 on or associated with the plate 16 and lid 52. When the screw 74 is inserted into the hole 46 in the plate 16 and tightened thereon, the screw 74 forms an electrical switch with the contacts 110. It is appreciated that a conductive washer may also be used with the screw in order to complete the circuit for the switch. The contacts may be made from a variety of conductive materials and not depart from the scope of the present invention. Suitable examples include, but are not limited to, conventional tin-plated circuit traces. Alternatively, conductive ink or gold plating could be used to maximize corrosion resistance and the life cycle of the contacts 110. Removal or the attempted removal of the screw 74 from engagement with the plate 16 re-opens or breaks the electrical path between the first and second contact 110, which can be detected by a security system or the like to indicate that the hinged product is being stolen, tampered with, etc. Although described as a remote device, it is appreciated that the security monitor or alarm system may be local.

Referring to FIG. 10, in one embodiment, the plate 16 includes a plurality of electrical circuits to detect when the device is armed and/or tampered with. In particular, an electrical circuit formed by a pair of contacts 120 that are each connected to a conductive filament or wire 122 that attach to a light emissive device such as an LED 38 may be used to indicate when the device is armed. In particular, the contacts 120 coact with contacts 124 on or associated with the insert 54 to form an electrical circuit and illuminate the LED 38 or LED 108 when the plate 16 is inserted in the second anchor assembly 14. It is also appreciated that the electrical circuit is attached to an alarm system 19 so that any attempts to cut the plate 16 will break the wires 122 so as to break the electrical circuit and activate the alarm.

The plate 16 may also include a filament 130 that is connected to a pair of contacts 132 through a pair of filaments or wires 134. In operation, when the plate is inserted into the second anchor assembly 14, the contacts 132 coact with contacts 136 to form an electrical circuit. When used with a plastic first anchor assembly 12, when the anchor assembly 12 is welded together, the halves of the bottom half of the first anchor assembly 12 hooks onto the filament 130. If the first anchor assembly is broken, the filament 130 will break so as to break the circuit, thereby setting off or activating an alarm.

Figures 11, 12:
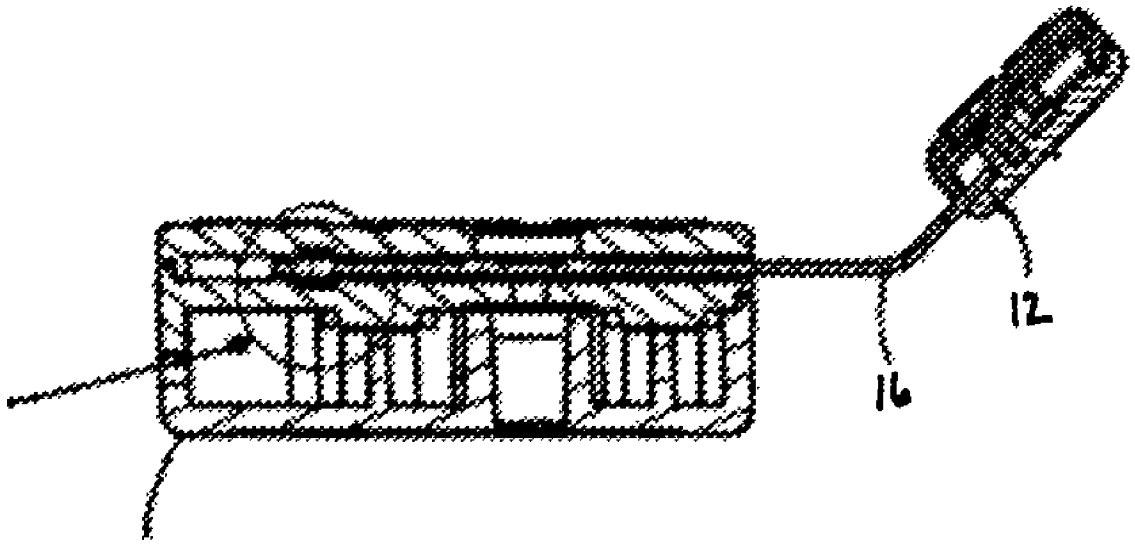
FIG. 11 is a cross sectional side view of another embodiment of the security device showing a pair of contacts for detecting the presence of the plate.
FIG. 12 is an enlarged partial view of the contacts and plate shown in FIG. 11 in an engaged position.
Figure 12:
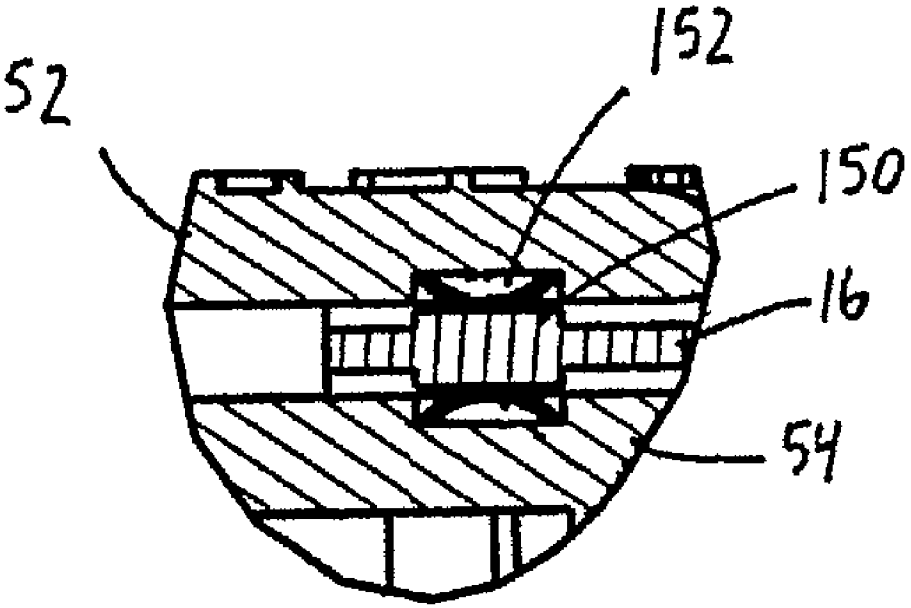

Referring now to FIGS. 11 and 12, another embodiment of the security device is shown using brush-type contacts. In one embodiment, brush-type contacts 152 are press fit into respective slots on the insert 54 and lid 52. When inserted into the lid assembly 70, raised portions 150 of the plate 16 engage the brush contacts 152 so as to complete an electrical circuit. Removal or attempted removal of the plate 16 from the lid assembly disengages the raised portions 150 from the brush-type contacts 152 so as to open the circuit and activate the alarm to indicate the security device is being opened or tampered with.

While the plate is shown as having a contiguous end, it is appreciated that the plate may include a slot defining a pair of tines to permit the plate to accept a post of a hinged product (e.g., a tablet computer). Each of the tines may include a hole for accepting a screw or other fastener to attach the plate to the second anchor assembly. It is also appreciated that other thin members other than plates such as, but not limited to, a cable may be used with the present invention to extend through the hinge and connect to the anchor assemblies.

Referring now to FIGS. 13 through 17, another embodiment of the security device of the present invention is shown and disclosed. The security device, generally designated by the numeral 300, is shown as having an anchor assembly 340, a tether or cord 18 for mechanically and/or electronically securing the security device, and a cable 404. Again, while the embodiment disclosed herein refers to a laptop computer, it is appreciated that the security device may be used with any type of hinged electronic product including, but not limited to, portable DVD players and video game players, and not depart from the scope of the present invention.

The anchor assembly 340 includes a base 350 and a lid 352, 353, and may be made out of a variety of materials including, but not limited to, plastic. A suitable material is a thermoplastic material such as Acrylonitrile-butadine-styrene (ABS) to provide suitable environmental ruggedness at a relatively low cost. While the lid is shown and disclosed as being made of two halves 352, 353, it is appreciated that it may be integrally formed and not depart from the scope of the invention.

Figure 13:
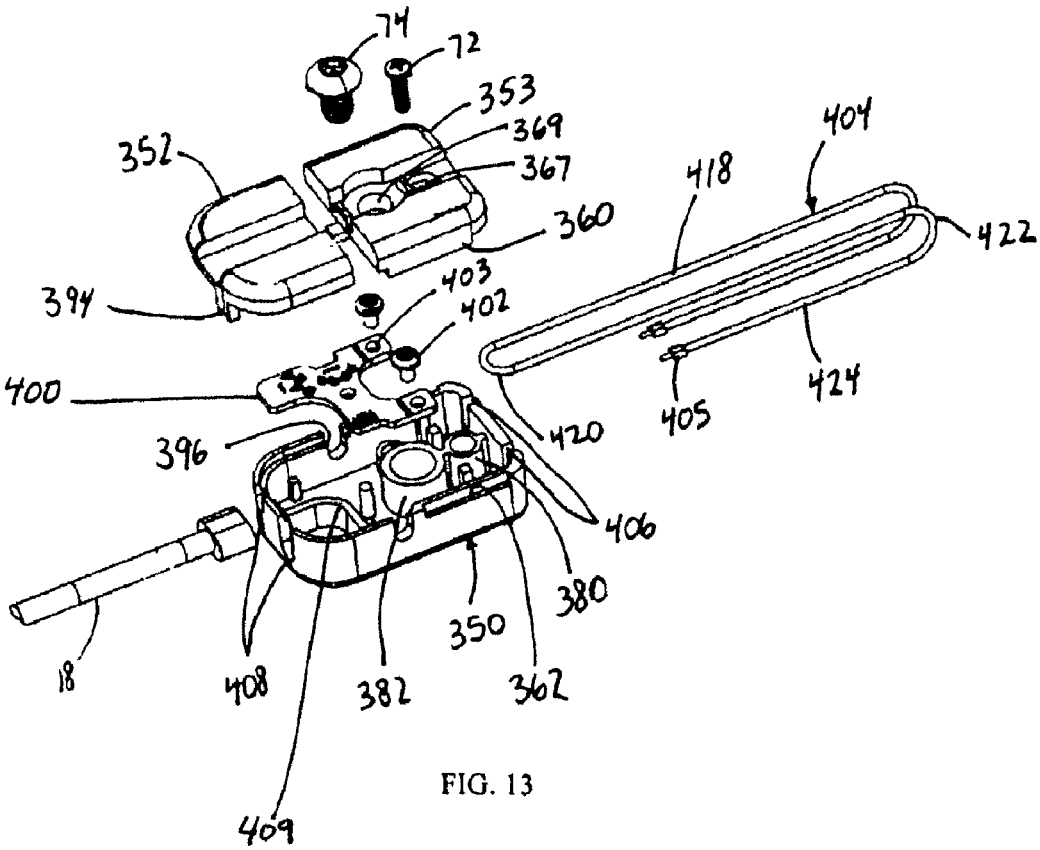
FIG. 13 is a partial exploded view of another embodiment of a security device of the present invention.
Figure 14:
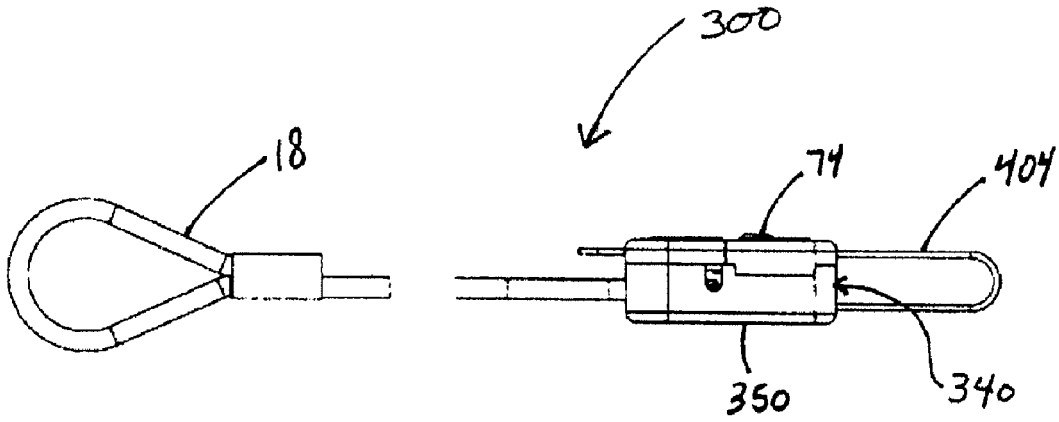
FIG. 14 is a partial side view of the security device of FIG. 13.
Figure 15:
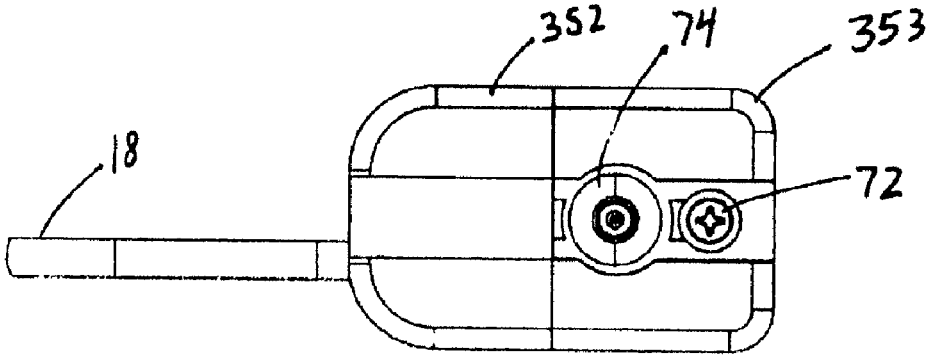
FIG. 15 is a top plan view of the security device of FIG. 13 without the cable.
Figure 16:
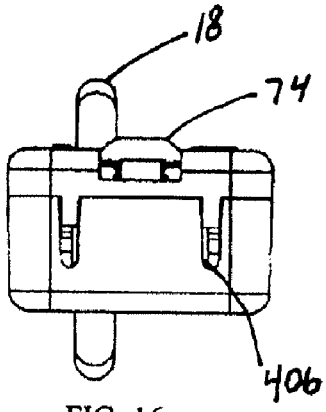
FIG. 16 is a side elevation view of the security device of FIG. 15.

In one embodiment, the base and lid are designed so that they create a substantially flush exterior when attached together. Referring now to FIG. 13, the lid 352, 353 may have one or more flange sections 360 that are sized to fit within corresponding channels or slots 362 in the walls of the base 350. In a preferred embodiment, the flange sections are sized to be received snugly within the channels of the walls of the base to prevent or limit the amount of movement or play of the lid relative to the base. Alternately, the lid or base may include a rim that is sized to fit within the walls of the other of the base or lid. Other known means for attaching the base to the lid and/or for limiting the relative movement of the base and lid including, but not limited to, pegs and corresponding holes may be used and not depart from the scope of the invention.

The base 350 and lid 352, 353 may be connected together through a plurality of fasteners. One embodiment, as shown in FIG. 13, utilizes a pair of bolts or screws 72, 74. In the embodiment shown, the lid 353 contains a pair of holes 367, 369 for the screws 72 and 74, while the base 350 includes corresponding threaded cylinders 380, 382 for receiving the respective screws 72, 74. It is appreciated that the security device may monitor the status of the screws through the use of a sensor operatively connected to the circuit board or alarm system in a known way, or through other known means, so that the removal or attempted removal of a screw will activate the alarm (e.g., by breaking a circuit) or otherwise provide notice of the potential tampering of the security device.

Ribs may be added to the base 350 to provide rigidity and additional support for the lid assembly 352, 354. As shown in FIGS. 13 to 17, the base 350 also includes a plurality of holes or slots 406, 408 having a slot width for permitting one or more tethers or cables having a cable width smaller than the slot width to allow the tethers or cables to extend therethrough to mechanically or electronically attach the security device. For example, as shown in FIG. 13, a lasso cable assembly 18 may be inserted through one of the holes 408 to attach or connect the cable assembly to the anchor assembly. The cable assembly may be used to tether the security device to an object (e.g., a table), thereby allowing a portable hinged electronic device to be moved over a limited allowable range, yet still be prevented from being stolen. A wall 409 may extend within the interior of the base 350 to limit the movement of the end of the cable assembly within the base 350 when attached.

The cable assembly also may include one or more wires or filaments operatively attached to an alarm system 19 to alert the user when the cable assembly is cut or tampered with or to send signals from electrical circuits or sensors as discussed herein. It is appreciated that the security device may include one or more additional cables or wires to connect the electrical circuits and sensors to the alarm system. In order to maintain or secure the cable assembly 18 within the opening 408, the lid 352 may include a post 394 that extends into the opening 408 to straddle or engage the cable assembly 18.

As shown in FIG. 17, a cable 410 may be attached to the circuit board 400 at 412 to operatively connect the circuit board 400 to an alarm system 19. The circuit board is preferably of an intelligent design. In one embodiment, the circuit board may monitor the resistance of the lasso, which may be made of a predictable resistance material (i.e., a material whose resistance varies by length to detect changes). A LED or other indicator on or operatively attached to the lasso assembly preferably indicates (e.g., flickers, blinks or illuminates) changes with or potential tampering with the lasso assembly and/or anchor assembly.

While the circuit board is shown as being attached to a remote alarm system, it is appreciated that the circuit board may be self-contained (e.g., the base may have an internal battery) and not depart from the scope of the present invention. Furthermore, although the lasso assembly may be made of a variety of materials, in one embodiment the lasso assembly may comprise Litz wire to facilitate the activation of an alarm when the lasso assembly is tampered with. For example, the Litz wire may form a loop inside the cable of the lasso assembly, wherein severing of the loop activates the alarm.

In the embodiment shown in the drawings, the circuit board 400 is sized and shaped to fit within the inside of the base 350. Referring to FIG. 13, a pair of legs are spaced apart to fit alongside the central threaded cylinder 382. Screws or bolts 402 may extend through holes 403 on the ends of the legs of the circuit board and into corresponding threaded channels 386 on the base to attach the circuit board 400 to the base 350.

The security device may also include a sensor 200 that may be attached to the hinged electronic product to detect the attempted removal of the security device from the hinged product. As shown in FIG. 17, the sensor may be electronically attached to a circuit board 400 by a cable, wire or other known means 414 at 416.

Referring now to FIG. 13, the cable 404 is sized and shaped to be secured to the anchor assembly and about the hinge or other post member of a laptop computer or other hinged electronic product. In one embodiment, the cable is a continuous cable having a pair of straight sections 418 that are spaced apart a distance sufficient to enable the straight sections 418 to be placed within a channel 430 of the top 352, 353 of the anchor assembly 350. Once the cable is in place, a fastener 74 may be tightened to secure the cable to the assembly. The curved end 420 connecting the two straight sections 418 will prevent the cable 404 from being withdrawn past the fastener 74 by a pulling force. Loosening of the fastener 74 will permit the cable to be adjusted relative to the anchor assemblies. In another embodiment, the straight sections 418 of the cable may extend through slots 406 and 408 of the anchor assembly 350.

Curved sections 422 at the opposite end of the straight sections 418 are sized and shaped to create an opening that can receive a hinge member or post of a laptop computer. Bottom straight sections 424 extend a sufficient distance from the curved sections 422 in substantially parallel planes to the top straight sections 418 to permit the ends 405 of the cable 404 to be secured within the anchor assembly 350. The ends of the cable preferably include enlarged members 405 having a diameter or width that is greater than the width of the slot 406 so that when the ends of the cable 404 are placed within the slots 406 of the anchor assembly 350, the ends 405 of the cable, along with the curved section 420 being held in place by fastener 74, act to maintain the cable 404 secured to the anchor assembly 350. While the parts of the cable are shown and disclosed as being straight and curved, it is appreciated that the cable may be flexible or otherwise formed or shaped differently and not depart from the scope of the present invention.

In one embodiment, the cable is a steel cable of sufficient size and strength to prevent the cable from being readily cut or severed. It is appreciated that the cable may be made from a conductive material so that the alarm system of the security device will be able to detect if the cable is cut or, in some cases, tampered with. The cable may also comprise Litz wire to facilitate the activation of an alarm when the cable is tampered with. For example, the Litz wire may form a loop inside the cable, wherein severing of the loop activates the alarm.

It will be understood that modifications and variations may be effected without departing from the scope of the novel concepts of the present invention, but it is understood that this application is limited only by the scope of the appended claims.

The invention claimed is:

1. A security device for protecting an electronic hinged product on or associated with an object, wherein the hinged product has a hinge opening having a hinge height, the security device comprising:

an anchor assembly having at least one opening therein, the at least one opening having an opening width;

a cable having a cable width, two ends and extendable through the hinge opening about the hinge, the cable being operatively attached to the anchor assembly, wherein the cable width is smaller than the opening width;

wherein each of the two ends of the cable includes an enlarged end member having a width greater than then the opening width to retain the ends of the cable in the anchor assembly; and a tether connecting the security device to the object.

2. The security device of claim 1 which further comprises an alarm unit.

3. The security device of claim 2 which further comprises a coiled alarm operatively connected to the alarm unit.

4. The security device of claim 1 wherein the anchor assembly is made from plastic.

5. The security device of claim 1 wherein the anchor assembly comprises a base and a lid assembly, and which further comprises at least one lid fastener having a head portion for connecting the base to the lid assembly.

6. The security device of claim 5 wherein the at least one opening of the anchor assembly comprises a plurality of slots for receiving the cable.

7. The security device of claim 6 wherein the plurality of slots each have a slot width and wherein the cable has two end members having a width that is larger than the slot widths to retain the end members within the anchor assembly.

8. The security device of claim 5 where the lid assembly comprises a hole for receiving the at least one lid fastener in a recessed fashion.

9. A security device for protecting an electronic hinged product on or associated with an object, wherein the hinged product has a hinge opening having a hinge height, the security device comprising:

an anchor assembly having a base and a lid assembly;

a cable extendable through the hinge opening about the hinge, the cable being operatively attachable to the anchor assembly;

a tether connecting the security device to the object; and at least one lid fastener having a head portion for connecting the base to the lid assembly, wherein the fastener has a head and which further comprises first and second contacts disposed within the anchor assembly so that when the fastener is inserted, the head of the fastener completes an electrical circuit between the first and second electrical contacts.

10. The security device of claim 9 which further comprises a conductive washer to complete the electrical circuit between the first and second electrical contacts.

11. The security device of claim 1 which further comprises at least one electrical circuit disposed within the anchor assembly to indicate when the security device is tampered with.

12. The security device of claim 11 which further comprises an indicator that indicates when the security device is armed.

13. The security device of claim 12 wherein the indicator is a light emissive device.

14. A security device for protecting an electronic hinged product on or associated with an object, wherein the hinged product has a hinge opening having a hinge height, the security device comprising:

an anchor assembly;

a cable extendable through the hinge opening about the hinge, the cable being operatively attachable to the anchor assembly;

a tether connecting the security device to the object; and at least one electrical circuit disposed within the anchor assembly to indicate when the security device is tampered with, wherein the electrical circuit comprises a filament attached to the anchor assembly, wherein breakage of the anchor assembly breaks the filament to activate an alarm.

15. The security device of claim 11 wherein the electrical circuit comprises a circuit board.

16. The security device of claim 15 wherein the circuit board is an intelligent circuit board.

17. The security device of claim 1 which further comprises a sensor operatively attached to the security device and the hinged product, wherein the sensor is in a closed state when attached to the hinged product and an open state when detached from the product.

18. The security device of claim 1 wherein the cable is made of steel.

19. The security device of claim 1 wherein the cable is made from conductive material.

20. The security device of claim 19 wherein the cable is made from Litz wire.

21. The security device of claim 1 wherein the tether is made from a predictable resistance material.

22. The security device of claim 1 wherein the tether comprises at least one wire of filament operatively attached to an alarm to indicate when the tether is tampered with.

23. A security device for extending through a hinge opening in an electronic product on or associated with an object, the security device comprising:

a cable for extending about the hinge, wherein the cable has a cable width, two ends that include an enlarged end member having an end member width;

an anchor assembly comprising:

a base;

a lid assembly attached to the base; and at least one slot in the base or lid assembly, the at least one slot having a slot width that is larger than the cable width and smaller than the end member width for retaining the ends of the cable within the anchor assembly;

a tether connecting the security device to the object;

an alarm unit; and a sensor for detecting tampering with the security device.

24. A security device for extending through a hinge opening in an electronic product, the security device comprising:

a cable for extending about the hinge;

an anchor assembly comprising:

a base;

a lid assembly attached to the base; and at least one slot in the base or lid assembly for receiving the cable, wherein the at least one slot has a slot width and wherein the cable has two end members having a width that is larger than the slot width to retain the end members within the anchor assembly;

a tether connecting the security device to the object;

an alarm unit;

a sensor for detecting tampering with the security device;

at least one lid fastener having a head portion for connecting the base to the lid assembly, wherein the fastener has a head portion and which further comprises first and second contacts disposed within the second anchor assembly so that when the fastener connects the base to the lid assembly, the head of the fastener completes an electrical circuit between the first and second electrical contacts.

25. The security device of claim 23 wherein the sensor comprises at least one electrical circuit disposed within the anchor assembly to indicate when the security device is tampered with.

26. The security device of claim 25 which further comprises an indicator that indicates when the security device is armed.

27. The security device of claim 26 wherein the indicator is a light emissive device.

28. A security device for extending through a hinge opening in an electronic product, the security device comprising:

a cable for extending about the hinge;

an anchor assembly comprising:

a base;

a lid assembly attached to the base; and at least one slot in the base or lid assembly for receiving the cable;

a tether connecting the security device to the object;

an alarm unit; and a sensor for detecting tampering with the security device, the sensor comprising at least one electrical circuit disposed within the anchor assembly to indicate when the security device is tampered with, wherein the electrical circuit comprises a filament attached to the first anchor assembly, wherein breakage of the first anchor assembly breaks the filament to activate an alarm.

29. The security device of claim 23 wherein the sensor for detecting tampering with the security device comprises a sensor operatively attached to the security device and the hinged product, wherein the sensor is in a closed state when attached to the hinged product and an open state when detached from the electronic product.

30. A security device for extending through a hinge opening in an electronic product on or associated with an object, the security device comprising:

a cable for extending about the hinge, wherein the cable has a cable width, two ends that include an enlarged end member having an end member width;

an anchor assembly having at least one slot having a slot width that is larger than the cable width and smaller than the end member width for retaining the ends of the cable within the anchor assembly;

a tether connecting the security device to the object;

an alarm unit;

a circuit board located within the anchor assembly and operatively connected to the alarm unit; and a sensor operatively connected to the circuit board for detecting tampering with the security device.

* * * * *

UNITED STATES PATENT AND TRADEMARK OFFICE

CERTIFICATE OF CORRECTION

PATENT NO. : 7,768,397 B1
APPLICATION NO. : 11/686412
DATED : August 3, 2010
INVENTOR(S) : Kelsch et al.

It is certified that error appears in the above-identified patent and that said Letters Patent is hereby corrected as shown below:

Column 7, line 19, replace "plastite" with --PLASTITE®--.

Column 9, line 4, replace reference numeral "354" with --353--.

Column 10, line 60, delete the word "then".

Signed and Sealed this

Twenty-eighth Day of September, 2010

David J. Kappos

David J. Kappos
*Director of the United States Patent and Trademark Office*